US005507126A

United States Patent [19]

Wu

[11] Patent Number: 5,507,126

[45] Date of Patent: Apr. 16, 1996

[54] CORRUGATED METAL PLATE

[76] Inventor: Tsan-Hsing Wu, No. 42, Kee Koou St., Shin Her Tsun, Shin Shyh Hsiang, Tai-Nan Hsien, Taiwan

[21] Appl. No.: 280,518

[22] Filed: Jul. 26, 1994

[51] Int. Cl.[6] ..... E04D 1/00

[52] U.S. Cl. ..... 52/536; 52/543; 52/546; 52/335

[58] Field of Search ..... 52/536, 537, 538, 52/543, 546, 547, 588.1, 549, 550, 335, 336

[56] References Cited

U.S. PATENT DOCUMENTS

| | | | |
|---|---|---|---|
| 2,112,178 | 3/1938 | Selph | 52/537 X |
| 3,524,292 | 8/1970 | Bottom | 52/588.1 X |
| 3,906,696 | 9/1975 | Poter et al. | 52/536 |
| 4,133,161 | 1/1979 | Lester | 52/543 X |

*Primary Examiner*—Kien T. Nguyen
*Attorney, Agent, or Firm*—Browdy and Neimark

[57] ABSTRACT

A corrugated metal plate comprises a metal plate provided at two opposite sides thereof with an insertion cap and an insertion seat. Two or more corrugated metal plates are joined together side by side by fastening the insertion cap of one corrugated metal plate with the insertion seat of another corrugated metal plate. The corrugated metal plate is further provided with a predetermined number of ridges located between the insertion seat and the insertion cap.

3 Claims, 2 Drawing Sheets

CORRUGATED METAL PLATE

FIELD OF THE INVENTION

The present invention relates generally to a corrugated metal plate, and more particularly to a corrugated metal plate having an improved connection means.

BACKGROUND OF THE INVENTION

The corrugated metal plates are light in weight and can be made economically. As a result, they are widely used in building factories, gymnasiums, auditoriums, residential buildings, warehouses, etc.

As shown in FIG. 1, a conventional corrugated metal plate 10 is provided at one side thereof with a fastening seat 11 and at another side thereof with an insertion cap 12. In the processing of combining the corrugated metal plates 10, a saddle seat 15 is fastened by means of a screw 14 on a steel purlin 13 located at the connection point between two corrugated metal plates 10. The saddle seat 15 is urged by the fastening seat 11 of the corrugated metal plate 10 such that the saddle seat 15 and the fastening seat 11 are fastened by a screw 16. The insertion cap 12 of another corrugated metal plate 10 is retained by the fastening seat 11. The conventional connecting structure of the corrugated metal plate 10 described above has inherent shortcomings, which are expounded explicitly hereinafter.

It is costly and time-consuming to use the saddle seat 15 to support and fasten the connecting structure of the corrugated metal plates 10.

The fastening effect between the fastening seat 11 and the saddle seat 15 can be easily undermined by the corrugated metal plates 10 which are susceptible to expansion and contraction caused by the climatic factors, such as temperature fluctuation, sunlight, wind, rain, etc. In other words, the screws 14 and 16 which are used to fasten the fastening seat 11 and the saddle seat 15 are vulnerable to becoming loosened. Once the screws 14 and 16 have become loosened, the threaded holes, in which the screws 14 and 16 are received, are prone to an abrasion caused by oxidation, thereby resulting in a reduction in the service life span of the corrugated metal plates 10.

SUMMARY OF THE INVENTION

It is therefore the primary objective of the present invention to provide simple and economic connecting means of the corrugated metal plates.

It is another objective of the present invention to provide the corrugated metal plates with connecting means having a fastening effect which can not be undermined by the climatic factors.

In keeping with the principle of the present invention, the foregoing objectives of the present invention are attained by a corrugated metal plate, which includes an insertion seat and an insertion cap. The insertion seat and the insertion cap are integral parts of a corrugated metal plate and are disposed respectively at two opposite sides of the corrugated metal plate. Two corrugated metal plates are fastened together side by side by fastening the insertion cap of one corrugated metal plate with the insertion seat of another corrugated metal plate.

The foregoing objectives, features, functions and advantages of the present invention will be more readily understood upon a thoughtful deliberation of the following detailed description of the present invention in conjunction with the accompanying drawings.

DETAILED DESCRIPTION OF THE INVENTION

Figure 1:
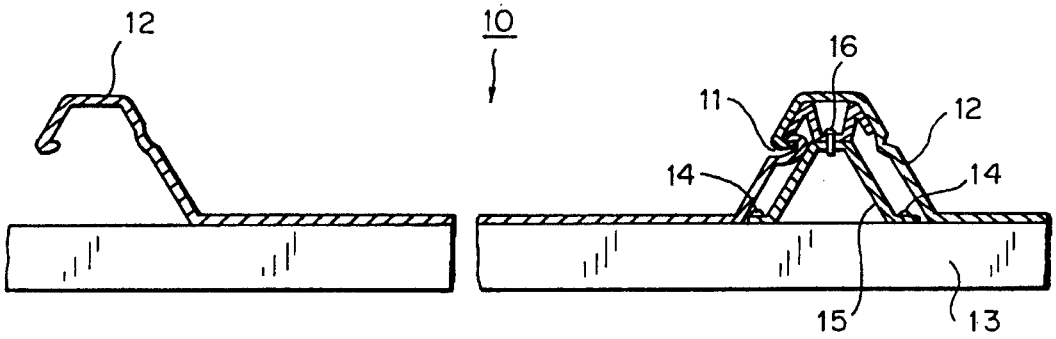
FIG. 1 PRIOR ART
FIG. 1 shows a sectional schematic view of a prior art connecting means of the corrugated metal plates.
Figure 2:
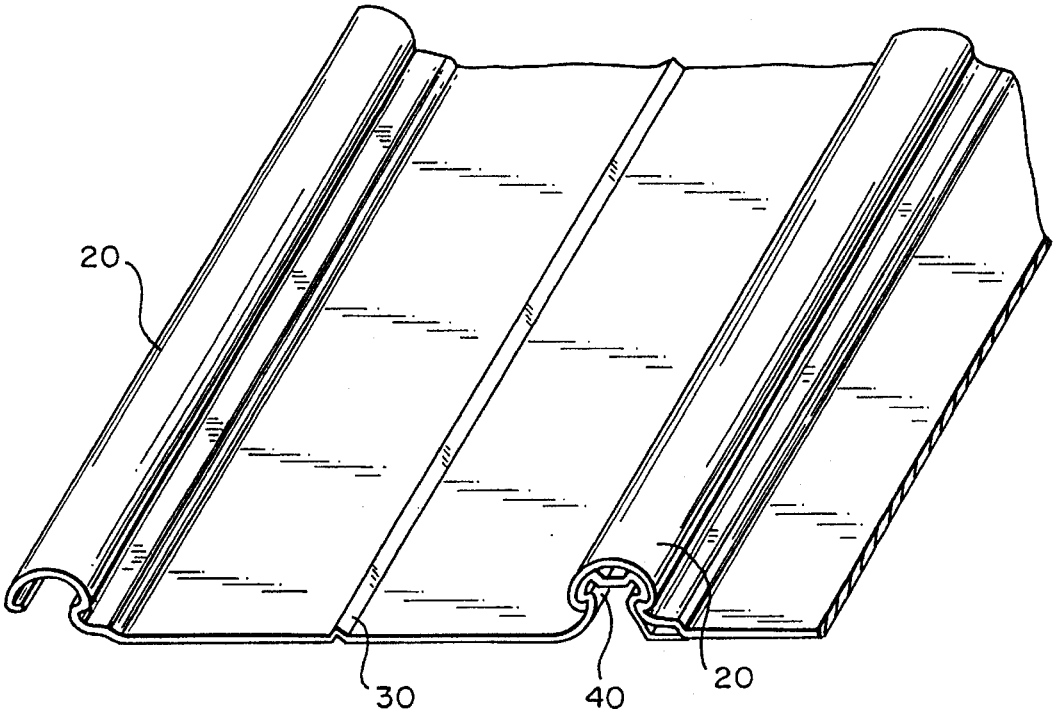
FIG. 2 shows a perspective view of two corrugated metal plates in combination according to the present invention.
Figure 3:
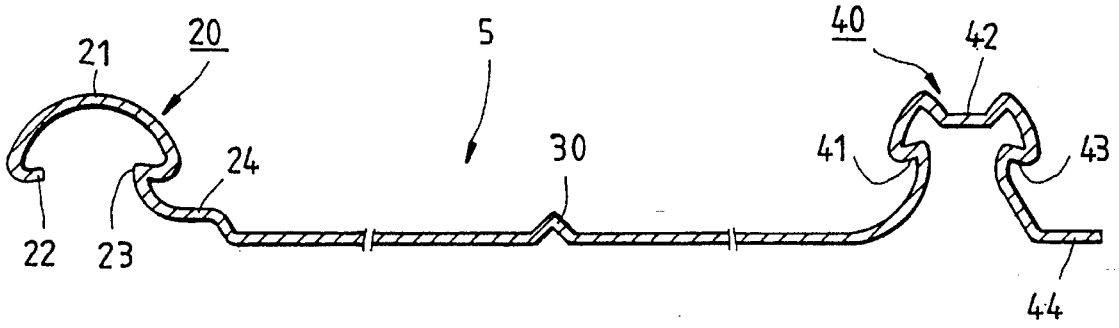
FIG. 3 shows a sectional schematic view of two corrugated metal plates in combination according to the present invention.
Figure 4:
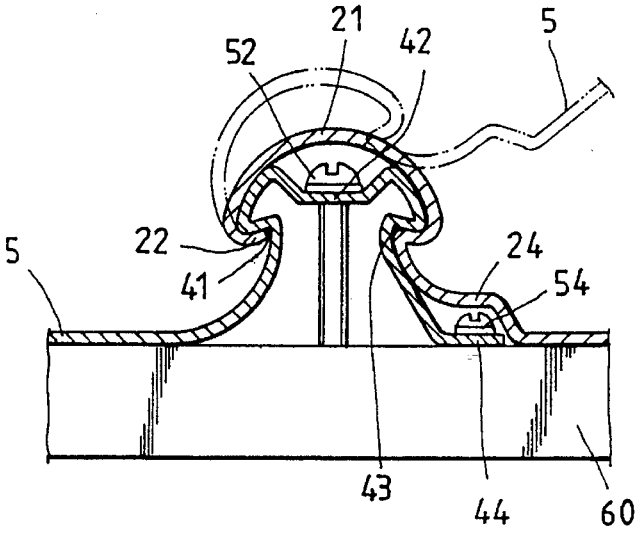
FIG. 4 shows a sectional schematic view of a connecting means of the corrugated metal plates according to the present invention.

As shown in FIGS. 2–4, a corrugated metal plate 5 of the present invention is integrally made of a colored steel plate by rolling. Located at two opposite sides of the corrugated metal plate 5 are an insertion cap 20 and an insertion seat 40, which are parallel to each other. Located at the midsegment of the upper surface of the corrugated metal plate 5 is a ridge 30. The insertion cap 20 has a top portion 21, which is similar in shape to a mushroom cap and is provided at one end of the base thereof with a first retaining portion 22 of a hooklike construction. The top portion 21 is further provided with a second retaining portion 23, which is opposite in location to the first retaining portion 22. The second retaining portion 23 has one end, which extends inwards in the direction toward the ridge 30 to form a rib 24 of an arcuate construction. The rib 24 is located at a level higher than that of the upper surface of the corrugated metal plate 5. The insertion seat 40 is provided centrally at the top thereof with an upper supporting surface 42. Located at one end of the base of the insertion seat 40 is a first retaining slot 41, which faces inwards in the direction toward the ridge 30. The insertion seat 40 is further provided with a second retaining slot 43 opposite in location to the first retaining slot 41. The second retaining slot 43 has one end which extends downward to form a lower supporting surface 44 which is located at the same level as the upper surface of the corrugated metal plate 5 and is provided longitudinally with a predetermined number of screw holes (not shown in the drawings) for receiving therein a predetermined number of screws which are used to fasten the corrugated metal plate 5 to a steel purlin 60.

As shown in FIG. 4, a first corrugated metal plate 5 is fastened to the steel purlin 60 by means of screws 52 and 54 which are fastened respectively onto the purlin 60 via the screw holes of the upper supporting surface 42 and the lower supporting surface 44. A second corrugated metal plate 5 is joined with the first corrugated metal plate 5 such that the first retaining portion 22 of the insertion cap 20 of the second corrugated metal plate 5 is retained securely in the first retaining slot 41 of the insertion seat 40, and that the second retaining portion 23 of the insertion cap 20 of the second corrugated metal plate 5 is retained securely in the second retaining slot 43 of the insertion seat 40, and further that the insertion seat 40 is enclosed in the interior of the top portion 21 of the insertion cap 20, as shown in FIG. 4. It must be noted here that the screw 54 is fastened onto the purlin 60 in such a manner that the head of the screw 54 remains under the rib 24 of the insertion cap 20 without interfering the insertion cap 20.

The corrugated metal plate 5 of the present invention is further provided with the ridge 30, which serves to lessen the impact of the temperature fluctuations on the corrugated metal plate 5 and to prevent the screw 52 from becoming loosened. As a result, the service life span of the corrugated metal plate 5 of the present invention is effectively prolonged. In addition, the umbrellalike top portion 21 of the insertion cap 20 gives an added esthetic effect to the corrugated metal plate 5 of the present invention and serves to lessen the impact of rain or wind on the corrugated metal plate 5 of the present invention.

The corrugated metal plate of the present invention has several inherent advantages, which are summed up hereinafter.

The corrugated metal plates of the present invention can be joined together easily and rapidly.

The corrugated metal plate of the present invention is provided with connection means devoid of a saddle seat of the prior art and can be therefore worked on easily and economically.

The corrugated metal plate of the present invention is provided with an umbrellalike insertion cap which serves to enhance the esthetic effect of the corrugated metal plate of the present invention and which serves to lessen effectively the wind resistance of the corrugated metal plate of the present invention and to prevent the stress concentration of the corrugated metal plate of the present invention.

The corrugated metal plate of the present invention is provided with the insertion seat and the insertion cap, which are curved appropriately to lessen the impact of the temperature fluctuations on the corrugated metal plate of the present invention.

The corrugated metal plate of the present invention is provided at the midsegment thereof with a ridge, which serves to minimize the adverse impact of the temperature fluctuations of the fastening effect of the screw of the corrugated metal plate of the present invention.

The embodiment of the present invention described above is to be regarded in all respects as merely illustrative and not restrictive. Accordingly, the present invention may be embodied in other specific forms without deviating from the spirit thereof. The present invention is therefore to be limited only by the scope of the following appended claims.

What is claimed is:

1. A corrugated metal plate comprising a metal plate which is provided integrally at one side thereof with an insertion cap and is further provided integrally at another side thereof with an insertion seat; wherein said insertion cap comprises an umbrellalike top portion having a base provided at one side thereof with a first retaining portion and at another side thereof with a second retaining portion which has one end extending downwards in the direction toward the middle of said metal plate to form a rib located at a level higher than an upper surface of said metal plate; wherein said insertion seat is provided centrally at a top thereof with an upper supporting surface which has one end extending downwards in the direction toward said middle of said metal plate to form a first retaining slot engageable with said first retaining portion of said insertion cap of another one of said metal plate, said upper supporting surface further having another end extending downwards in the direction opposite to said first retaining slot to form a second retaining slot engageable with said second retaining portion of said insertion cap of another one of said metal plate, said second retaining slot having one end extending downwards in the direction opposite to said middle of said metal plate to form a lower supporting surface located at the same level as said upper surface of said metal plate; and wherein said upper supporting surface and said lower supporting surface of said insertion seat are provided respectively with a fastening hole dimensioned to receive therethrough a fastening means.

2. The corrugated metal plate according to claim 1 wherein said metal plate is provided with a predetermined number of ridges located between said insertion cap and said insertion seat.

3. A corrugated metal plate adapted to be joined to other ones of the plate to cover a flat surface, the plate having parallel corrugations, the plate in a direction taken perpendicular to an extension of the corrugations including a sequence of corrugations, the sequence comprising:

an insertion cap including an arcuate top portion, a first retaining portion lip and a second retaining portion lip at opposite ends of the arcuate top portion, the first retaining portion lip including an edge of the plate; the first retaining portion lip and the second retaining portion lip being disposed at a first height above the surface;

a rib disposed at a second height above the surface less than the first height, the rib being partially parallel to the surface and connecting with the second retaining portion lip distal the top portion; the second height being at least equal to a plate thickness plus a screw head thickness;

a flat first segment lying on the surface, having a first segment width and being connected to the rib distal the second retaining portion lip;

a central ridge having a third height less than the first height and being connected to the first segment;

a flat second segment lying on the surface, having a second segment width equal to the first segment width and being connected to the rib distal the first segment;

an insertion seat including a partially arcuate upper portion, a first retaining slot connected to the second segment lip and a second retaining slot lip, the first retaining slot and the second retaining slot lip being at opposite ends of the upper portion; the first retaining slot lip and the second retaining slot lip being disposed at the first height above the surface plus the plate thickness, the partially arcuate upper portion including an arcuate inner curve substantially congruent with the arcuate top portion of the insertion cap less the plate thickness, the partially arcuate upper portion of the insertion seat including a depressed supporting surface at a middle section thereof, the supporting surface being disposed below the arcuate inner curve by at least the screw head thickness and including a first plurality of screw holes;

a lower supporting surface connected to the second retaining slot lip distal the upper portion, the lower supporting surface including a second plurality of screw holes.

* * * * *